US005410330A

United States Patent [19]

Simson et al.

[11] Patent Number: 5,410,330

[45] Date of Patent: Apr. 25, 1995

[54] SCROLL DISPLAYING DEVICE

[76] Inventors: Anton K. Simson, 13227 Aubrey, Poway, Calif. 92064; Peter C. Brusso, 1480 Calico La., Escondido, Calif. 92029

[21] Appl. No.: 67,738

[22] Filed: May 26, 1993

[51] Int. Cl.[6] ..... G09G 3/00

[52] U.S. Cl. ..... 345/110

[58] Field of Search ..... 345/57, 110; 352/174, 352/180; 353/109; 318/6, 7; 348/722

[56] References Cited

U.S. PATENT DOCUMENTS 3,726,031 4/1973 Singer .
4,012,674 3/1977 Spitsbergen et al. ..... 318/7
4,720,661 1/1988 Kisakibaru et al. ..... 318/6
4,942,411 7/1990 Polston ..... 353/109

*Primary Examiner*—Jeffery Brier
*Attorney, Agent, or Firm*—Henri J. A. Charmsson; John D. Buchaca

[57] ABSTRACT

A scroll displaying mechanism suitable for use in moving advertising displays, chart recorders and tape readers uses a pair of D.C. motors wired to operate under slightly different speed-controlling voltages in order to maintain the displayed part of the scroll between two rollers taut. A simple belt and pulley drive mechanism for each roller assures quiet and vibration-free operation. The viewing time between frame-advance and the scroll direction reversal are controlled by detection of different length markers positioned along one edge of the scroll.

14 Claims, 2 Drawing Sheets

SCROLL DISPLAYING DEVICE

FIELD OF THE INVENTION

This invention relates to mechanisms for driving a display or recording medium scrolling between two rollers.

BACKGROUND OF THE INVENTION

Scrolling charts, banners or tapes that are alternately wound back and forth between a pair of rollers are commonly used on chart recorders, advertising displays and other devices where information must be continuously or intermittently displayed. In order to assure a smooth regular winding of the scrolling band and avoid creases and folds in the displayed section of the band between supply and take-up rollers, the band must be kept taut. This can be achieved by careful synchronization if the roller movements through precise guiding mechanisms, or by using tensioning idle rollers as disclosed in U.S. Pat. No. 3,726,031 Singer.

When separate motors are used to drive the rollers the speeds of the motors must be carefully matched. The scrolling system driving mechanism of the prior art are often complex, using driving gear assemblies which tend to be noisy and subject to vibration. The complexity of the prior art mechanism results in substantial cost of parts and assembly labor.

The present invention results from a search for a simple, yet precise and inexpensive scrolling chart mechanism that can be used on relatively small and portable devices particularly suitable for face-to-face teaching and sales presentation, window displays, as well as entertaining and decorative home photographic displays.

SUMMARY OF THE INVENTION

The principal and secondary objects of this invention are to provide a compact scrolling chart mechanism using a relatively small number of simple and inexpensive components, yet capable of providing a reliable and steady automatic display system that is quiet, vibration-free, reliable and easy to load and operate.

These and other objects are achieved by driving each roller with an inexpensive D.C. motor at slightly different speeds in order to maintain a steady tension of the scrolling chart, and by coupling the motors to the rollers through sets of pulley and belt speed reducers using resilient O-rings as belts in order to effectively dampen the drive mechanism and assure a smooth scrolling of the displayed material.

DESCRIPTION OF THE PREFERRED EMBODIMENT OF THE INVENTION

Figures 1, 2, 3:
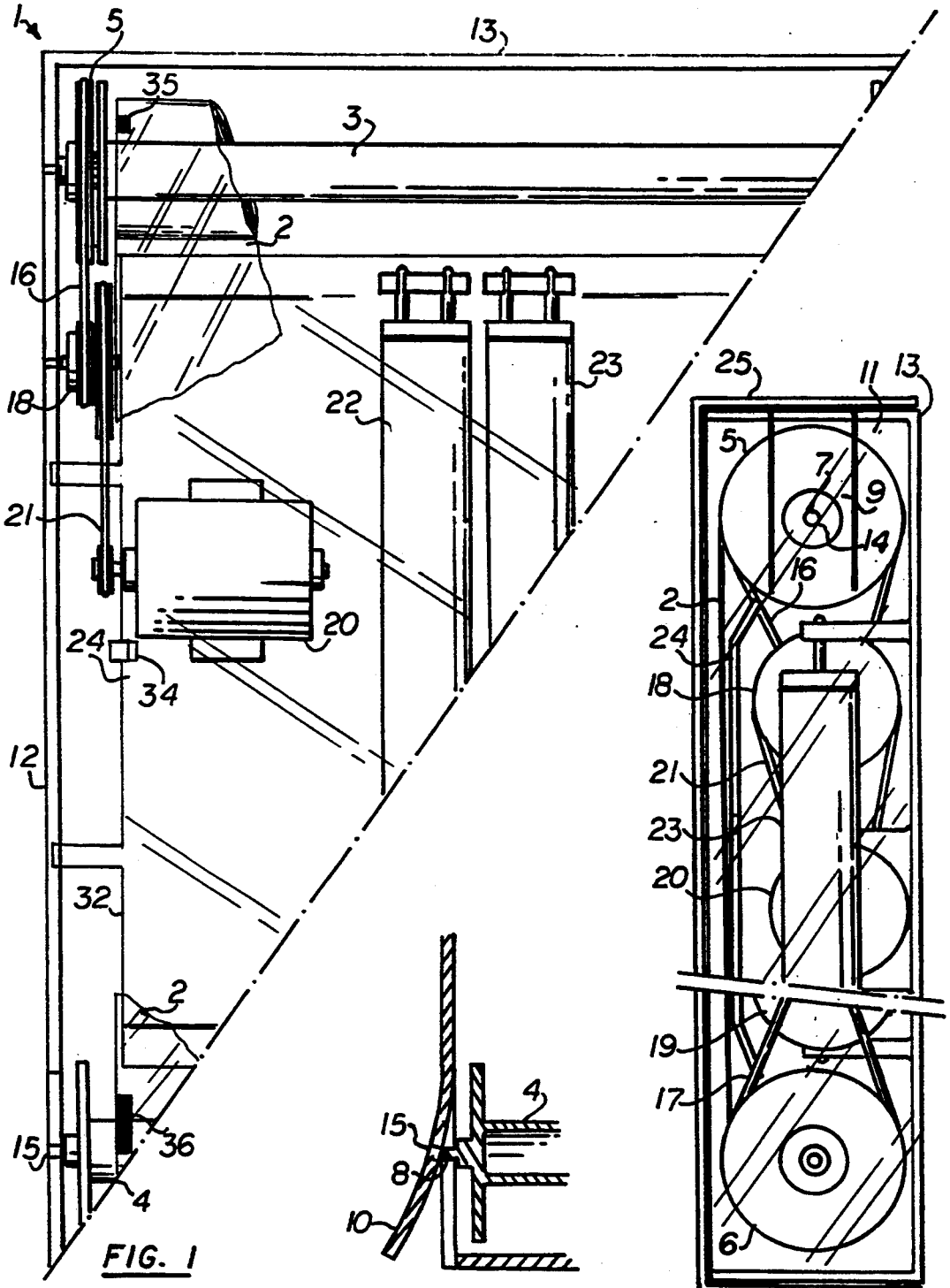
FIG. 1 is a one-half elevational front view of the uncovered scroll displaying apparatus; the missing half being a mirror image thereof.
FIG. 2 is a partial right side elevational view.
FIG. 3 is a detail cross-sectional view of the roll-locking mechanism.

Referring now to the drawing, there is illustrated in FIGS. 1 and 2 a driving mechanism 1 for a scrolling chart 2 only partially and transparently illustrated, the opposite ends of which are wound around two parallel and spaced-apart rollers 3 and 4. Each roller 3, 4 has one end engaged into a driving pulley 5, 6. The other end has a spindle 7, 8 rotatively engaged into a section 9, 10 of a lateral wall 11, 12 of the housing frame 13. The roller-holding section 9, 10 is cut along three sides from the lateral wall 11, 12 so that it can be bent out, as illustrated in FIG. 3, to facilitate the engagement of the spindle 7, 8 into the bearing hole 14, 15 bored therethrough.

Each driving pulley 5, 6 is rotatively secured to one of the lateral walls 11, 12 and is coupled by means of a belt 16, 17 to a speed-reducing pulley assembly 18, 19 that is itself driven by a D.C. motor 20 by means of a belt 21. The belts 16, 17, 21 including the one not illustrated in the drawing and associated with the second motor driving the lower roller, are preferably inexpensive elastic O-rings that are resiliently stretched over the coupling pulleys. The use of this type of belt and pulley assembly provides a damping mechanism between the D.C. motor and the rollers. The mechanism is free of the noise and vibration inherent to spur-gear and worm-gear mechanisms used in the prior art. Moreover, the absence of such spur or worm-gear linkage allows for one of the motors and its associated coupling to be totally or partially dragged by the other motor through the scroll or chart 2. This last-described feature is particularly relied upon in this embodiment, as will be further explained, to maintain a certain tension of the scroll chart.

A pair of fluorescent tubes 22, 23 are mounted in the center of the housing frame 13 to provide backlighting of the scrolling chart 2. The tubes and part of the driving mechanism are covered by a translucent shroud 24 which doubles as a sliding surface for the scrolling chart.

Figure 4:
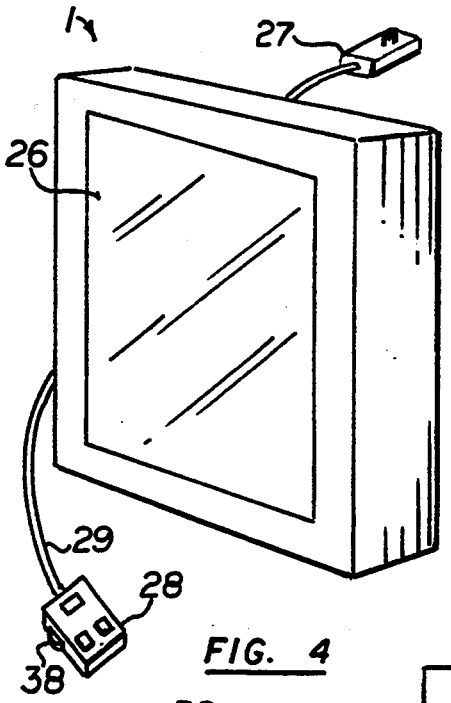
FIG. 4 is a perspective view of the apparatus.

As more specifically illustrated in FIG. 2, a cover 25 wrapping around the front face and sides of the frame 13 completes the housing assembly. Although the frame 13 and cover 25 have been illustrated as totally transparent in FIGS. 1–2 they should preferably be made of an opaque or translucent material except for the central viewing window portion 26 of the cover which should be kept transparent as illustrated in FIG. 4.

In the preferred embodiment the apparatus is powered by a 12-volt D.C. current provided by a plug-in transformer and rectifier unit 27. The apparatus is operated by means of a control unit 28 which houses a series of switches and knobs, and is linked to the back of the frame 13 by way of a control cable 29.

One of the key features of the invention is the use of inexpensive D.C. motors of the type commonly found in toys which are run at slightly different speeds, but in the same direction in either the forward or reverse direction. The motor corresponding to the roller upon which the scrolling chart is being wound is powered by a slightly higher voltage than the other motor associated with the roller from which the chart is being taken. Accordingly, the second or dragging motor and associated pulley and roller are partially pulled through the intermediate area by the scrolling chart itself. This results in a slight tensioning of the chart which avoids creasing, folding and uneven scrolling. The different voltages applied to the motors and their resulting free speeds should be broad enough to accommodate the speed varying diameters of the rollers and resulting speed variations inherent to the system when one roller is being loaded while the other is being unloaded through the scrolling operation. Although the tensioning and regulating effect could be obtained by shutting off power to the second dragging motor, this approach would require the use of more powerful and therefore bigger and more expensive motors. By providing some power to the second motor and thus moving it in the same direction, the pulling force required from the first motor is considerably reduced.

Figure 5:
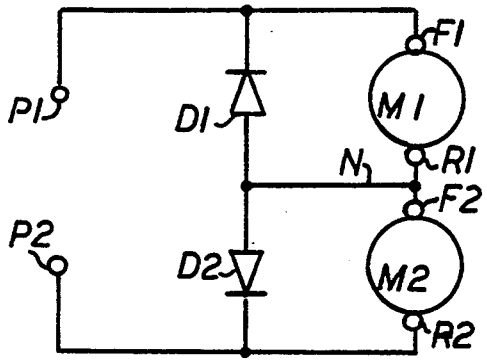
FIG. 5 is a simplified diagram of the motor-driving circuit.

FIG. 5 illustrates the power scheme used in supplying different voltages to the D.C. motors M1, M2 from a pair of power terminals P1, P2.

The motors run in a forward direction when a positive potential is applied on their respective forward winding terminals F1 and F2, and a reference or negative potential is applied to their reverse winding terminals R1 and R2. Such motors operate over a range of applied voltage and their speed increase with the applied voltage. The motors are wired in series between the power terminals P1, P2, and each motor winding is shunted by a diode D1, D2 or any other unidirectional current conducting device with the anodic poles of the diodes connected to the node point N between the two motors, and the cathodic poles of the diodes connected to the respective power terminals P1 and P2. When a positive forward-driving voltage is applied between the power terminals, the voltage across the second motor M2 is limited by the voltage drop inherent to the second diode D2 while the first motor M1 is subject to the difference between the voltage applied to the power terminals and the voltage drop across the second diode D2. Similarly, if the polarity of the voltage applied to the power terminals is inverted, the voltage applied to the first motor M1 is limited by the voltage drop across the first diode D1 while the second motor M2 will be subject to the same higher voltage that M1 was subject to during the forward-driving sequence. Moreover, it can be understood that by proper selection of the type and number of diodes or other types of unidirectional current-carrying devices used to shunt the respective motors, the relative speeds of the motors can be accurately set in both forward and reverse directions. The voltage drop across the shunting diode or diodes must be equal to or greater than the minimum operating voltage of the motor.

Figure 6:
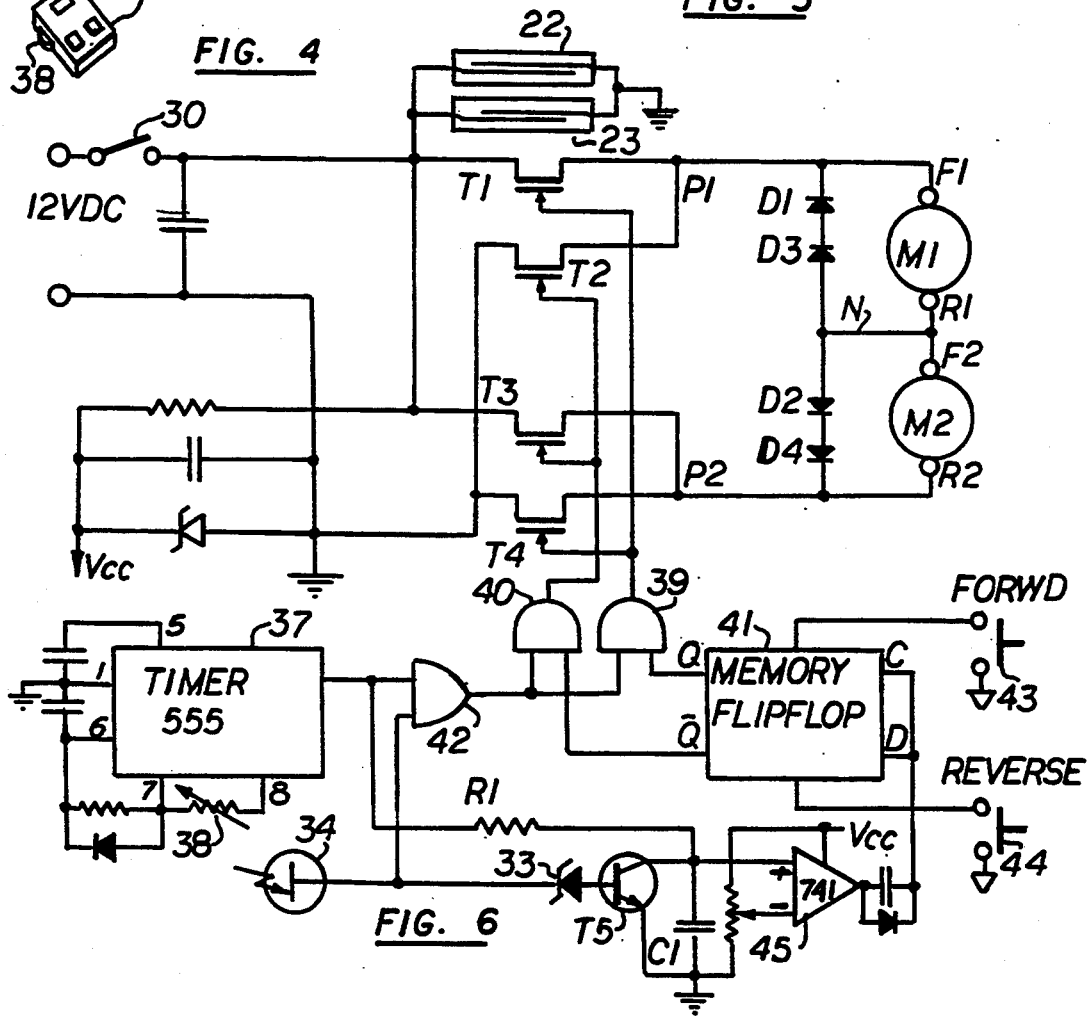
FIG. 6 is an electrical schematic of the apparatus.

The operation of the preferred embodiment of the apparatus will now be explained by reference to the schematic of FIG. 6. The D.C. motors M1 and M2 have a voltage range of 1 to 12 volts. Upon closure of the power switch 30 the 12-volt D.C. voltage from the transformer-rectifier unit 27 is applied to the circuitry. FET switches T1–T4 are used to alternately apply a positive 12-volt potential and ground reference to either power terminal P1 or P2. Diodes D1–D4 are used to apportion the voltages applied to motors M1 and M2. If we assume that each diode has a forward voltage drop of 1 volt, during forward drive operation, i.e., when the positive voltage is applied to terminal P1, 10 volts will be applied across the first motor M1 and 2 volts across the second motor M2. During a reverse scrolling operation, i.e., when transistors T2 and T3 are open and transistor T1 and T4 are closed, 10 volts will be applied to the second motor M2 and 2 volts only across motor M1. These driving voltages can be adjusted by adding or suppressing one or more of the diodes. It should be noted that it is not necessary that each motor be shunted with the same number of diodes. One may adjust the number of diodes to obtain a faster reverse speed than the forward speed by shunting the first motor M1 with a lesser number of diodes than motor M2. The forward or reverse operation is controlled by a memory flip-flop 31 which can be manually preset in either direction by activating either the forward switch 43 or the reverse switch 44 on the control unit 28. A photo sensor 34 is positioned to detect marks placed along one edge 32 of the chart or scroll 2. Two types of marks are used, a short mark or indicia 35 is used to locate the middle of each frame to be viewed except the first and last frame. A longer mark or indicator 36 is used to signal the middle of the first and last frame on the chart. As the chart advances the output signal of the photo sensor 34 conditioned by zener diode 33 and inverter T5 is analyzed in conjunction with the output signal of the timer 37 to either, cut the supply of the driving voltage fed to the motors by switching off all transistors T1–T4, or reverse the polarity of the driving voltage by enabling either the forward direction control transistors T1 and T4 or the reverse direction control transistors T2 and T3.

The two control gates 39, 40 are alternately enabled by the outputs of the memory flip-flop 41, and by the output of the timing gate 42. The memory flip-flop 41 can be manually preset to the forward or reverse mode by the control unit pushbutton switches 43 and 44. The flip-flop is also toggled by the output signals of an operational amplifier 45 wired as a voltage comparator.

The timer 37 is basically an astable multivibrator which delivers a fixed, short move command and a viewing-time signal. The latter can be adjusted by means of potentiometeric switch 38 controlled by a thumb-wheel on the side of the control unit 28.

At the end of the frame-viewing period, as the output of the timer 37 goes high with the move command, the control gates are enabled through timing gate 42. The motors are then energized in the forward or reverse direction depending upon the status of the memory flip-flop 41. By the time the short move command expires and the timer output goes low, the frame indicia has moved from under the photo sensor 34, and its now high output keeps the control gates enabled through the timing gate 42. As the next mark on the chart reaches the photo sensor, the sensor output signal drops, cutting the power to the motors. The scrolling mechanism continues to move for a short time under its own momentum. If the sensed mark was a short frame-center indicia, it will be close to or already have moved past the sensor by the time the mechanism stops. The next move command will trigger a repetition of the just-described sequence. If, by contrast, the sensed mark is a long end-of-scroll indicator 36, part of the mark will remain under the photo sensor as the mechanism comes to a full stop. The move command pulse delayed by the R1/C1 circuit and biased by the high output of the inverter T5 is sensed by the operational amplifier 45 whose output toggles the memory flip-flop, thus reversing the direction of the motors.

The structural, mechanical and electrical simplicity of this scroll-display device allows for the manufacture of reliable, yet inexpensive displays ranging in heights from approximately 15 cm (6 inches) to 75 cm (30 inches) suitable for displaying a variety of charts made of paper, fabric, mylar or other synthetic materials.

A scroll of fifty 20 cm×20 cm (8×10 inches) frames on a 25 microns (1 mil) thick printable plastic material results in a 3 cm (1.2 inch) diameter roll. The apparatus using this size of scroll requires a housing having overall dimensions of no more than 30×22.5×4.25 cm (12×9×1.7 inches).

An alternate embodiments of the apparatus can be powered by an internal set of batteries. In order to reduce the power requirement, the backlights 22, 23 can be eliminated. Instead, the back of the frame 13 is left transparent or translucent. The electrical control can be limited to a double-pole/double-throw rocker switch substituting for switches T1–T4, thus eliminating the timing and mark-detecting circuitry.

While the preferred embodiment of the invention has been described, modifications can be made and other embodiments may be devised without departing from the spirit of the invention and the scope of the appended claims.

What is claimed is:

1. A scroll displaying apparatus which comprises:

a first roller dimensioned to wind said scroll thereupon;

a second roller parallelly spaced-apart from the first roller, and dimensioned to wind said scroll thereupon;

a first D.C. motor, and first means for coupling said first D.C. motor to said first roller;

a second D.C. motor, and second means for coupling said second D.C. motor to said second roller;

means for differentially apportioning a driving voltage applied to said motors whereby a higher fraction of said driving voltage is applied to one of said motors than to the other, including means for switching said higher fraction from one of said motors to the other in response to a reversal of polarity of said driving voltage;

wherein said means for differentially apportioning comprises:

each of said motors having a forward winding terminal and a reverse winding terminal, wherein the reverse winding terminal of said first motor and the forward winding terminal of the second motor are jointly connected to a node;

first means for unidirectionally conducting current between said node and the forward winding terminal of the first motor, wherein said higher fraction is determined by a voltage drop across said first means for unidirectionally conducting current; and means for applying said driving voltage between the forward winding terminal of the first motor and the reverse winding terminal of the second motor.

2. The apparatus of claim 1, wherein said means for differentially apportioning comprise second means for unidirectionally conducting current between said node and the reverse winding terminal of the second motor.

3. The apparatus of claim 2, which further comprises means for changing the amplitude of said higher fraction in response to said reversal of polarity.

4. The apparatus of claim 2, wherein said first means for unidirectionally conducting current comprise means for adjusting a voltage drop across said first means for unidirectionally conducting.

5. The apparatus of claim 3, wherein said second means for unidirectionally conducting comprise means for adjusting a voltage drop across said second means for unidirectionally conducting.

6. The apparatus of claim 2, wherein each of said means for coupling comprises at least one set of pulleys and a resilient belt stretched around said pulleys.

7. The apparatus of claim 6, which further comprises a scroll having opposite ends wound around said first and second rollers; and means for controlling movements of said scroll between said first and second rollers.

8. The apparatus of claim 7, wherein said means for controlling comprise means for detecting approach of one of said ends as said scroll is wound from one of said rollers to the other; and means responsive to said means for detecting for reversing the polarity of said driving.

9. A scroll displaying apparatus which comprises:

a first roller dimensioned to wind said scroll thereupon;

a second roller parallelly spaced-apart from the first roller, and dimensioned to wind said scroll thereupon;

a first D.C. motor, and first means for coupling said first D.C. motor to said first roller;

a second D.C. motor, and second means for coupling said second D.C. motor to said second roller; and means for differentially apportioning a driving voltage applied to said motors whereby a higher fraction Of said driving voltage is applied to one of said motors than to the other, including means for switching said higher fraction from one of said motors to the other in response to a reversal of polarity of said driving voltage;

wherein each of said means for coupling comprises at least one set of pulleys and a resilient belt stretched around said pulleys;

wherein said apparatus further comprises a scroll having opposite ends wound around said first and second rollers; and means for controlling movements of said scroll between said first and second rollers;

wherein said means for controlling comprise means for detecting approach of one of said ends as said scroll is wound from one of said rollers to the other; and means responsive to said means for detecting for reversing the polarity of said driving voltage; and wherein said means for controlling comprise:

a plurality of spaced-apart frame indicia located along said scroll, and at least one scroll-end indicator located proximately to one of said ends;

means for detecting said indicia and said end indicator; and means responsive to said means for detecting, for temporarily disconnecting said driving voltage from said motors upon detection of one of said indicia and for reversing the polarity of said driving voltage upon detection of said end indicator.

10. The apparatus of claim 9, wherein each of said indicia comprises a first mark of a given longitudinal length along one edge of said scroll;

said indicator comprises a second mark having a different longitudinal length than said first mark; and said means for detecting comprises means for differentiating between said first and said second marks.

11. The apparatus of claim 1, which further comprises:

a frame mounting said rollers;

each of said rollers having one end rotatively engaged by said frame;

said frame having at least a partially cut-out wall section having a resiliently movable portion engaging said end of one of said rollers.

12. A scroll displaying apparatus which comprises:

a first roller;

a second roller parallelly spaced-apart from the first roller;

first and second D.C. motors;

means for coupling said first D.C. motor to said first roller and for coupling said second D.C. motor to said second roller;

said first and second D.C. motors being connected in series between first and second power terminals;

a first diode element shunting said first D.C. motor;

a second diode element shunting said second D.C. motor;

each of said diode elements having a cathodic anode connected to one of said first and second power terminals;

means for applying a D.C. voltage across said first and second power terminals; and means for alternately reversing the polarity of said voltage across said power terminals;

wherein each of said means for coupling comprises at least one set of pulleys and a resilient O-ring stretched around said pulleys.

13. A scroll displaying apparatus which comprises:

a first roller dimensioned to wind said scroll thereupon;

a second roller parallelly spaced-apart from the first roller, and dimensioned to wind said scroll thereupon;

a first D.C. motor, and first means for coupling said first D.C. motor to said first roller;

a second D.C. motor, and second means for coupling said second D.C. motor to said second roller;

means for differentially apportioning a driving voltage applied to said motors whereby a higher fraction of said driving voltage is applied to one of said motors than to the other, including means for switching said higher fraction from one of said motors to the other in response to a reversal of polarity of said driving voltage;

means for controlling movements of said scroll between said first and second rollers;

a plurality of spaced-apart frame indicia located along said scroll, and at least one scroll-end indicator located proximately to a first end of said scroll;

means for detecting said indicia and said end indicator; and means responsive to said means for detecting, for temporarily disconnecting said driving voltage from said motors upon detection of one of said indicia and for reversing the polarity of said driving voltage upon detection of said end indicator.

14. The apparatus of claim 13, wherein each of said indicia comprises a first mark of a given longitudinal length along one edge of said scroll;

said indicator comprises a second mark having a different longitudinal length than said first mark; and said means for detecting comprises means for differentiating between said first and second marks.

* * * * *